United States Patent [19]

Ward et al.

[11] Patent Number: 4,736,552

[45] Date of Patent: Apr. 12, 1988

[54] ROOF INSULATION SYSTEM AND METHOD OF FABRICATION THEREFOR

[76] Inventors: Lonnie R. Ward; Cherryl A. Ward, both of P.O. Box 493, Lewisville, Tex. 75067

[21] Appl. No.: 840,899

[22] Filed: Mar. 18, 1986

Related U.S. Application Data

[63] Continuation-in-part of Ser. No. 657,380, Oct. 3, 1984, Pat. No. 4,635,423.

[51] Int. Cl.[4] ..... E04B 5/00

[52] U.S. Cl. ..... 52/94; 52/93; 52/309.13; 52/408; 52/410; 52/478; 52/743; 52/746; 52/748

[58] Field of Search ..... 52/93, 94, 743, 746, 52/748, 410, 408, 407, 478, 309.13, 222; 156/71

[56] References Cited

U.S. PATENT DOCUMENTS

| | | | |
|---|---|---|---|
| 2,587,985 | 3/1952 | Elmendorf | 52/746 X |
| 2,861,525 | 11/1958 | Curtis et al. | 108/6.5 |
| 3,121,649 | 2/1964 | Oliver | 52/748 X |
| 3,135,070 | 6/1964 | Waring et al. | 52/94 |
| 3,694,306 | 9/1972 | Fricklas | 161/205 |
| 3,735,538 | 5/1973 | Ramins | 52/94 |
| 3,969,863 | 7/1976 | Alderman | 52/407 |
| 4,050,972 | 9/1977 | Cardinal, Jr. | 156/71 |
| 4,147,003 | 4/1979 | Alderman | 52/743 X |
| 4,151,692 | 5/1979 | Holcombe | 52/309.13 X |
| 4,213,282 | 7/1980 | Heckelsberg | 52/478 X |
| 4,233,791 | 11/1980 | Kuhl et al. | 52/743 X |
| 4,303,713 | 12/1981 | Clemensen et al. | 52/743 X |
| 4,361,993 | 12/1982 | Simpson | 52/508 X |
| 4,393,634 | 7/1983 | McDermott et al. | 52/309.1 |
| 4,446,665 | 5/1984 | Berger | 52/478 X |
| 4,557,092 | 12/1985 | Brueske | 52/408 |
| 4,566,239 | 1/1986 | Smigel | 52/407 |
| 4,602,468 | 7/1986 | Simpson | 52/222 X |

*Primary Examiner*—Alfred C. Perham

*Attorney, Agent, or Firm*—Hubbard, Thurman, Turner & Tucker

[57] ABSTRACT

A roof system and method of roof fabrication for a building having in place a plurality of parallel and spaced apart elongated structural support units defining a longitudinal surface exposed from above. Fabrication is effected by first applying a double faced adhesive tape longitudinally along the top surface of the support units after which flexible moisture impervious sheeting suitable to function as a vapor barrier is sequentially applied in lengths from rolls in a laterally spaced apart relation directly onto the adhesive tape of adjacent support units. This is followed by applying another length of sheeting intermediate and in contact with double faced adhesive tape applied over the borders of the adjacent previously applied sheeting into an overlapping seamed relation to render the sheeting continuous and uninterrupted. A blanket of non-laminated fiberglass is unrolled in continuous juxtaposed sections transversely over the vapor barrier sheeting after which hard roofing is applied and secured over the insulation to complete fabrication. The resulting roof system affords a structure having an attractive appearance, relatively long life expectancy and a relative low-cost of fabrication as compared to similar purpose systems of the prior art.

22 Claims, 2 Drawing Sheets

ROOF INSULATION SYSTEM AND METHOD OF FABRICATION THEREFOR

This application is a continuation-in-part of application Ser. No. 657,380 filed Oct. 3, 1984, now U.S. Pat. No. 4,635,423.

TECHNICAL FIELD

The technical field to which the invention pertains comprises the field of roof fabrication for installing roofing on commercial buildings having exposed roof joists or purlins.

BACKGROUND OF THE INVENTION

The roof support structure of a commercial or industrial type building is typically constructed of parallel spaced apart joists or purlins on which are supported the various component elements comprising the roof. The fabrication and constructions of such roofs can vary widely and are exemplified by the disclosures of U.S. Pat. Nos. 2,861,525; 3,694,306; 3,969,863; 4,233,791; 4,303,713; 4,393,634; 4,472,920 and 4,566,239.

Several decades ago, the only essential purpose of a roof on most buildings was to protect and enclose the interior spacing against the weather elements. With the advent of temperature controlled space, particularly air conditioning as now known, the use of insulation associated with the roof structure has become increasingly important. Not only does the insulation provide a greater comfort factor within the conditioned space, but it also serves to reduce the capital cost and operating cost of the conditioning equipment. Common therefore to the current prior art roof constructions is the requirement for a vapor barrier, a predetermined quantity of insulation and a generally protective layer of hard roofing typically in a form of a metal or other suitable overlayer secured to the roof supports. Various types of insulation material are known for that purpose and typically comprise fiberglass, celluloses, rockwool and other materials available for the purpose. Fiberglass blankets, as commonly utilized, contains a vinyl, foil or papered vapor barrier laminated along one face. Characteristically, the lamination of the vapor barrier to the fiberglass tends to crush the fiberglass rendering it less effective as an insulation while creating pin holes in the vapor barrier material. Via such pin holes vapor can penetrate to wet the insulation or condense on the underside of the superposed metal decking. As is well known, wetted insulation has significantly reduced resistance to thermal conductivity than does the same insulation when dry.

Insofar as various roof systems have been disclosed in the patents identified supra, they differ from each other in specific features of construction, method of application, useful longevity, finished appearance, ultimate degree of effectiveness for the intended purpose and/or cost of fabrication. It is known from the above, for example, to support vapor barrier sheeting on the underside of the purlins or to drape the vapor barrier from the top side of the purlins in order to position the insulation in the intervening space between purlins. It will be appreciated that much of the labor expended in the fabrication of such installations is conducted from a ladder, scaffold, or hydraulic lift from below the supports creating a high degree of discomfort to the workmen. Consequently they can be difficult, time consuming and relatively costly to install, not to mention the likelihood of imperfection in workmanship contributed by the personal discomforts associated with the work environment having to work overhead. A further problem associated with the foregoing has been a tendency in such installations to incur vapor leakage through the seams formed between adjacent sections of the vapor barrier causing both rusting of the purlins and metal decking and/or wetting of the insulation, that as mentioned above, deleteriously affects the insulation properties thereof.

Still another form of insulating roof fabrication disclosed in the patents above utilizes a lattice framework underlying the purlins in a positions intervening between the purlins and the rafters. Thereafter the roof is fabricated from above in a machine application of a vapor barrier faced insulation to between the purlins followed by a hard roofing extending over the insulation to represent the exterior exposed decking surface thereof.

The difficulties and complexities of such installations should be readily apparent yet despite recognition of the foregoing problems, a ready solution therefor has not heretofore been known.

SUMMARY OF THE INVENTION

The invention relates to roof fabrication for commercial and/or industrial buildings. More specifically, the invention relates to a novel method of fabrication for such roofing and a roof structure resulting from such fabrication that not only represents the height of simplicity for effecting fabrication, but at the same time results in a roof structure having significantly superior features as compared to similar purpose on-site fabricated roof systems of the prior art. Representing an important aspect of the present invention is the fact that fabrication is conducted entirely from above the plane of the roof support structure such that fabrication even partially from the underside in the manner of the prior art is completely eliminated.

To effect fabrication in accordance with the invention, an adhesive in the form of a double faced adhesive tape is applied longitudinally along the top surface of the purlins support structure. A roll of flexible sheeting of composition suitable as a vapor barrier and of width corresponding to the exterior transverse dimension between the relatively outer edges of the adjacent supports is unreeled directly onto the double faced tape previously applied to a first pair of adjacent supports. The sheeting is then applied similarly to the next pair of adjacent supports leaving an intermediate space between the adjacent support pairs uncovered by the sheeting. For covering the intermediate space the double faced adhesive tape is then applied along the border portions of the previously applied vapor barrier sheeting overlying the support pairs. This then enables an unreeling of vapor barrier sheeting from the roll onto the last applied tape for covering the intermediate spacing previously left uncovered while forming a seamed joint between the juxtaposed sections of sheeting. When installation of the vapor barrier sheeting in this manner has been completed over a subsequent surface area, an unfaced fiberglass blanket is unreeled from a roll in butt matched sections onto the sheeting in a direction transverse to the direction of the roof supports. In this arrangement, the vapor barrier sheeting functions not only to prevent moisture penetration but likewise serves as the support for the overlying fiberglass blanket. After the insulation has been unrolled eave to eave, hard roofing in the form of a standing seam metal roof panels are applied over the fiberglass with self tapping screws inserted into the purlins through the vapor barrier seam thereat. As an optional feature in fabrication, thermal blocks of board-like section can be utilized in alignment with the roof supports for elevating the roof and thereby enable thicker blankets of insulation to be accommodated.

As already noted, the foregoing represents the height of simplicity in the fabrication of such roofs by which all labor associated therewith is expended entirely above the support plane of the roof. Since an abundance of the material utilized in the fabrication is applied directly from rolled stock, the difficulties of fabrication is significantly minimized as compared to previous approaches therefor. At the same time, the end roof product results in a vapor barrier sheeting providing support for the insulation without the use of banding or the like in the manner of the prior art and when viewed from below presents a smooth and highly aesthetic appearance. The superior vapor seal provided by the sheeting utilizes concealed relatively unstressed seams so as to substantially if not completely eliminate the potential for leakage. By utilizing relatively inexpensive low density fiberglass blanket insulation from virgin vacuum packed stock, the insulation is readily able to recover to full thickness immediately on installation as to afford its full measure of insulating value without the attendant expense and damage problems associated with the more costly form of laminated fiberglass normally used in such installations.

It is therefore an object of the invention to provide a novel method for roof fabrication.

It is a further object of the invention to effect a novel roof system resulting from the fabrication of the previous object.

Those skilled in the art will recognize that the improved roof fabrication system and method of the present invention provides a clean appearing aestethically appealing roof structure which is economical and easy to install while eliminating many of the problems associated with vapor leakage and labor intensity associated with similar purpose fabrication methods and constructions of the prior art. Those skilled in the art will therefore recognize the above mentioned features and advantages of the present invention as well as additional superior aspects thereof upon reading the detailed description which follows in conjunction with the drawings.

DESCRIPTION OF THE PREFERRED EMBODIMENTS

Figure 1:
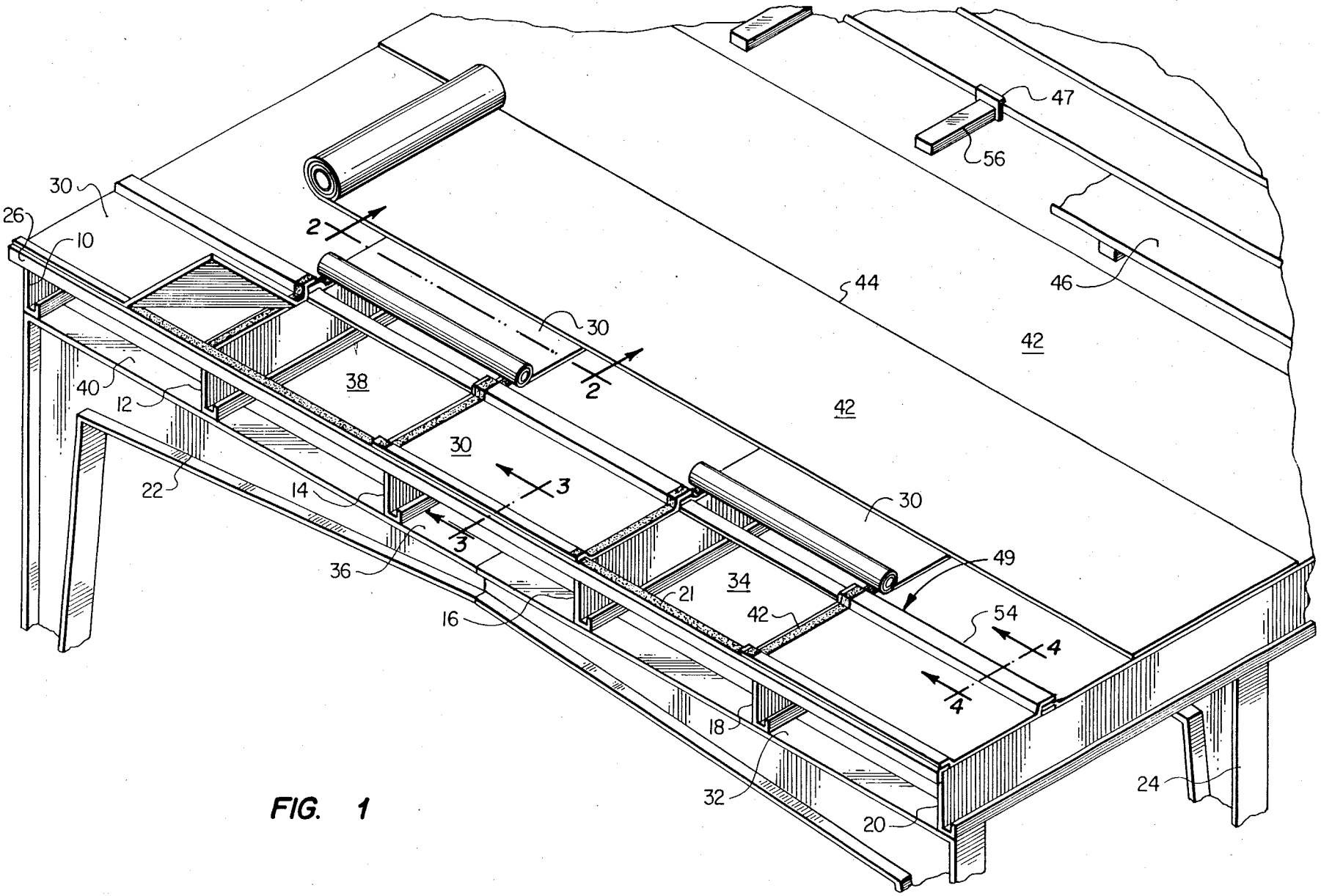
FIG. 1 is a fragmentary perspective view of a partially completed roof structure on which roof fabrication is being conducted in accordance with the invention.

In the description which follows, like parts are marked throughout the specification and drawings with the same reference numerals, respectively. The drawing figures are not necessarily to scale and certain features of the invention may be shown exaggerated in scale or in somewhat schematic form in the interest of clarity and conciseness.

Referring now to the drawings, there is disclosed a building roof structure comprised of a plurality of parallel spaced apart elongated Z shaped purlins 10, 12 14, 16, 18 and 20 commonly supported on girders 22 and 24. Extending transversely along the front upper face of the purlins is an elongated rake angle 26 for reasons as will be understood. Intermediate each adjacent pair of purlins is a generally open intervening space here designated 32, 34, 36, 38 and 40.

For fabricating the roof in accordance herewith, a layer of double faced adhesive tape 21 of a type commercially available is first extended from rolls longitudinally along the top face 28 of all of the purlins or alternatively on at least adjacent pairs and the intermediate sections of rake angle 26. With the tape 21 in place, a quantity of flexible vapor barrier sheeting 30 of width dimensions approximating the dimension X corresponding to the overlapped dimension of adjacent purlins is provided from rolled stock and oriented for unreeling in the longitudinal direction of the purlins. With the sheeting roll straddling, for example, purlins 10 and 12, the roll is unreeled in the direction of the purlins so that its opposite longitudinal borders engage the tape in substantial alignment with the purlin edges thereat. When completely laid, the applied sheet 30 will cover spacing 40. In the preferred embodiment the vapor barrier sheeting 30 is of a high grade commercially available impervious polypropylene-scrim-Kraft of about 10 mils thickness so as to afford a high level of tensile strength and resistance to tear.

On space 40 being covered for a minimum of at least about seven feet, a similar application of sheeting 30 is applied sequentially to the adjacent purlin pairs 14-16 and 18-20 overlying the alternate spacings 36 and 32 while leaving the intervening spacings 34 and 38 uncovered. Following completion of the latter, a second layer of double faced adhesive tape 21 is applied parallel and overlying the first layer onto the top border surface of the previously applied vapor barrier sheet 30. With the latter tape in place additional sheeting can then be unreeled similarly as before to extend thereover for spanning intervening spaces 34 and 38. This results in an overlapping seam (see FIG. 2) for providing a continuous and uninterrupted vapor barrier that will eventually extend over the entire roof area.

With the vapor barrier completely in place, rolls of light density fiberglass insulation 42 are sequentially unrolled transversely over the underlying vapor barrier forming a butt match seam 44 between contiguous insulation layers. As previously noted, insulation 42 in the preferred embodiment is non-laminated and vacuum packed fiberglass blanket that can readily recover to full thickness immediately after being laid into place. When all the insulation has been laid coextensively overlying the vapor barrier, the hard roofing 46 is applied thereover. In a preferred embodiment hard roofing 46 comprises a standing seam metal roof panel of a type commercially available although other suitable types could be utilized. The roof panels are interlocked at seams of about 24 inches on center by means of a substantially concealed clip 47 so as to eliminate fasteners. They are secured in place via a plurality of self tapping screws 48 inserted through the insulation and vapor barrier seam into the purlin flange surface 28 so as to contribute toward securing the vapor barrier in place.

Figure 4:
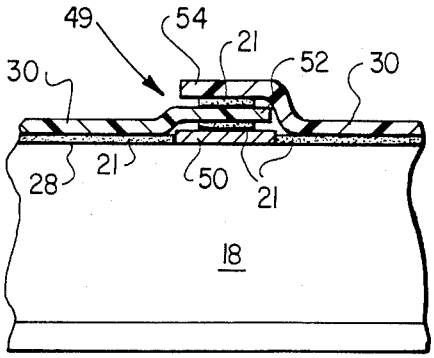
FIG. 4 is an enlarged sectional elevation as seen substantially from the position 4—4 of FIG. 1.

In the event the rolls of vapor barrier sheeting 30 are of insufficient length to extend the full length of the building, an intermediate seam 49 is formed at a convenient location hereshown displaced laterally inward from rake angle 26 as specifically illustrated in the exaggerated section of Fig. 4. As thereshown, the tape 21 is interrupted on purlin flange surface 28 by a transverse metal strip 50. The tape 21 is then extended along the top surface of the strip 50 so as to receive the forward cut end 52 of the original roll of vapor barrier sheet 30. After which, a subsequent application of tape 21 is applied transversely along the bordered surface of end 52 to receive the overlapping extension 54 in a seamed relation thereat.

Figure 2:
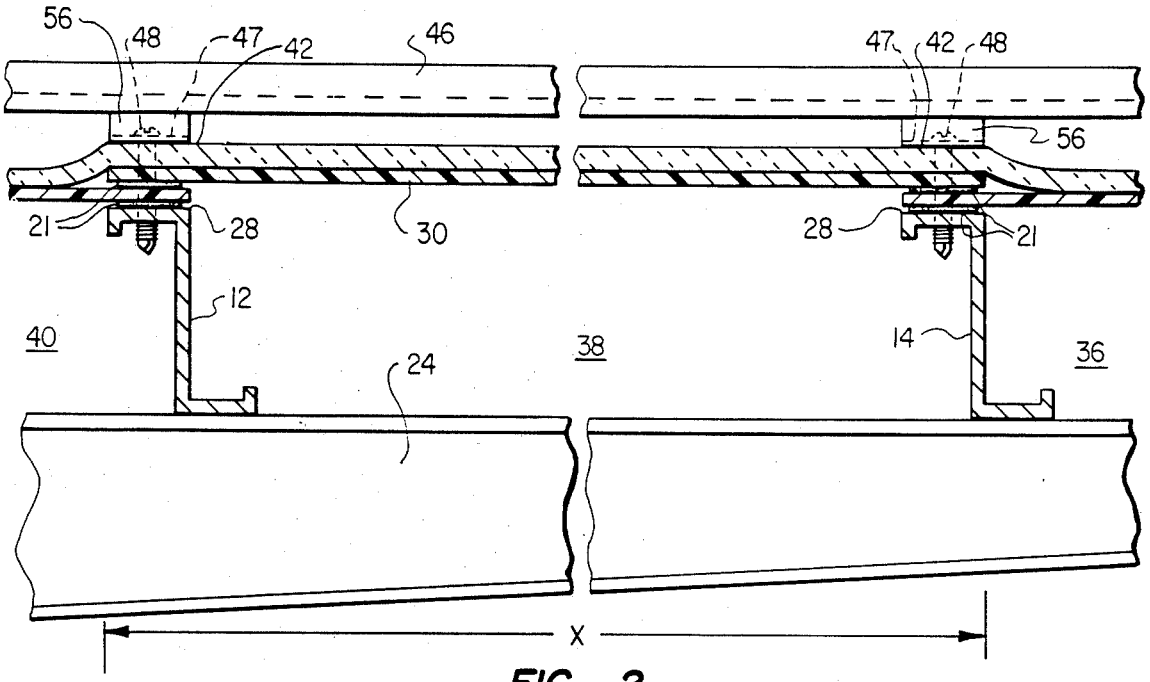
FIG. 2 is an enlarged sectional elevation as seen substantially from the position 2—2 of FIG. 1.
Figure 3:
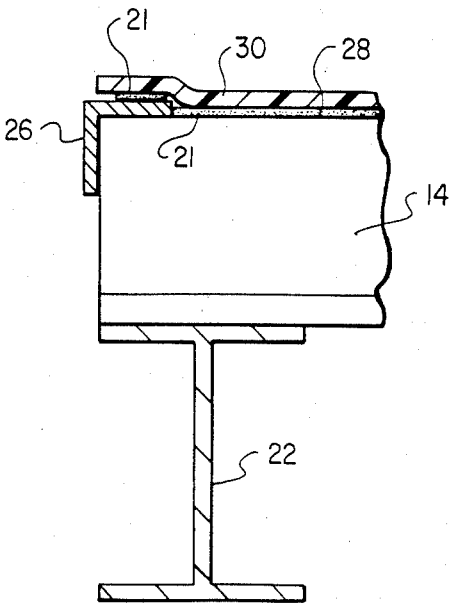
FIG. 3 is an enlarged sectional elevation as seen substantially from the position 3—3 of FIG. 1.

Optionally available for use herein are thermal blocks 56 positioned superposed over the purlins intervening between the insulation 42 and hard roofing 46. The thermal blocks typically are of a board-like cross section that can be 1 inch–3 inches in thickness to elevate the roof for accommodating increased thicknesses of insulation 42. Such thermal blocks are readily available from a variety of commercial sources and serve to minimize thermal short circuit at the point of compression of insulation 42 as best seen in FIG. 2.

By virtue of the above there has been disclosed a novel roof structure that is relatively simple and inexpensive to fabricate as compared to similar purpose fabrications of the prior art. Because all utilized labor is expended from above the roof supports rather than below, previous problems associated with underside fabrication is substantially if not totally eliminated. Each of the various materials can be readily applied in an orderly sequence and per se lends to large degree to automated installation and thereby further minimizing fabrication costs in reducing crew size required to effect fabrication. The end result is both aesthetically appealing and functionally adapted for longer trouble free longevity that can reasonably be expected from such similar purpose constructions of the prior art. Moreover, the system hereof virtually eliminates any "oil canning" wind noise inherent with many uninsulated and unsupported standing seam roof panel designs while reducing or eliminating concealed condensation. Most important, by keeping the insulation dry, the system hereof reduces heat loss through the roof via conduction and/or convection. Being that the vapor barrier per se comprises the support for the insulation, the prior use of banding exposed insulation is completely eliminated while forming a superior vapor seal because of the joint treatment physically utilized in seaming adjacent sections of the vapor barrier sheeting.

Since many changes could be made in the above construction and many apparently widely different embodiments of this invention could be made without departing from the scope thereof, it is intended that all matter contained in the drawings and specification shall be interpreted as illustrative and not in a limiting sense.

We claim:

1. A roof system for a building roof having in place roof supports comprising a plurality of parallel and spaced apart elongated structural support units having an uppermost longitudinal surface thereon defining a roof support plane exposed from above, said roof system comprising:

(a) a vapor barrier comprised of a plurality of joined section lengths of moisture impervious flexible sheeting extending longitudinally supported over the roof support plane surfaces of said structural units to span the intervening space therebetween substantially taut and unsupported thereover, each of said sections overlying adjacent of said units so as to cover intervening spacings between said units and with adjacent sections being joined longitudinally in an overlapping seamed relation with each other;

(b) substantially continuous insulation overlying said vapor barrier sheeting; and (c) hard roofing overlying and adjacent to said insulation and secured to said structural units.

2. A roof system for a building roof having in place roof supports comprising a plurality of parallel and spaced apart elongated structural support units having an uppermost longitudinal surface defining a roof support plane thereon exposed from above, said roof system comprising:

(a) a vapor barrier comprised of a plurality of joined section lengths of moisture impervious flexible sheeting extending longitudinally supported over the roof support plane surfaces of said structural units to span the intervening space therebetween substantially taut and unsupported thereover, said sections including first section lengths overlying over adjacent of said units so as to cover intervening spacings between said units while omitting coverage between adjacent of said first sections, and second section lengths longitudinally extending in an overlapping relation with the border portions of adjacent of said first section lengths,:

(b) substantially continuous insulation overlying said vapor barrier sheeting; and (c) hard roofing overlying and adjacent to said insulation and secured to said structural units.

3. A roof system in accordance with claim 2 in which said first vapor barrier sections are substantially coextensive in width with the transverse span dimension extending across the roof support plane surfaces of adjacent pairs of said support units.

4. A roof system in accordance with claim 3 in which said first vapor barrier section lengths and said second vapor barrier section lengths are substantially of like width.

5. A roof system in accordance with claim 4 in which the sheeting of said vapor barrier is comprised of flexible sheets spanning the intervening spacing between adjacent pairs of said structural units substantially in a sag free formation therebetween.

6. A roof system in accordance with claim 4 in which the sheeting of said vapor barrier is of a polymer plastic composition.

7. A roof system in accordance with claim 6 in which the first of said vapor barrier sections are adhesively mounted onto the roof support plane surfaces of said structural units and said second of said vapor barrier section lengths are adhesively seamed permanently to the border portions of adjacent of said first section lengths in an overlapped seam relation therewith.

8. A roof system in accordance with claim 7 in which said structural units are uniformly spaced apart, the roof plane surfaces thereof are individually substantially flat in a horizontal plane and there is included a double faced adhesive tape on said flat surfaces for a permanent receptive mounting of said first sections of vapor barrier sheeting lengths thereon.

9. A roof system in accordance with claim 8 including an elongated section of thermal block overlying the longitudinal surfaces of said structural units in an intervening relation between said insulation and said hard roofing.

10. A roof system in accordance with claim 8 in which said insulation comprises a predetermined thickness of nonlaminated fiberglass blanket.

11. A roof system in accordance with claim 8 in which said hard roofing is comprised of assembled standing seam roof panels secured to said structural units.

12. A roof system in accordance with claim 8 including a rake angle transversely spanning at least one common end of said structural units and said angle provides a receptive surface on which a common terminal end of said vapor barrier section lengths are mounted.

13. A roof system in accordance with claim 12 in which each of said section lengths are transversely seamed at a common location intermediate the longitudinal ends of said structural units.

14. A method of fabricating a roof for a building having in place a plurality of parallel and spaced apart elongated structural support units having an uppermost longitudinal roof support plane surface exposed units having an uppermost longitudinal roof support plane surface exposed from above and comprising the steps of:

(a) unrolling individual lengths of flexible moisture impervious vapor barrier sheeting from a source roll of said sheeting in the longitudinal direction of said support units for placing the sheeting onto the exposed roof support plane surface of said units substantially taut and unsupported therebetween;

(b) joining adjacent of said individual lengths longitudinally in an overlapping seamed relation with each other;

(c) applying substantially continuous insulation overlying said vapor barrier sheeting; and (d) securing a hard roofing to said support units in adjacent overlying relation to said insulation.

15. A method of fabricating a roof for a building having in place a plurality of parallel and spaced apart elongated structural support units defining an uppermost longitudinal roof support plane surface exposed from above and comprising the sequential steps of:

(a) sequentially unrolling individual lengths of moisture impervious flexible vapor barrier sheeting from a source roll of said sheeting in the longitudinal direction of said support units for mounting onto the exposed roof support plane surface of said units substantially taut and unsupported therebetween, said lengths being unrolled in a laterally spaced apart relation followed by unrolling a length intermediate and in border contact with said spaced apart lengths;

(b) applying substantially continuous insulation overlying said vapor barrier sheeting; and (c) applying a hard roofing over said insulation.

16. The method of fabrication in accordance with claim 15 in which each of said sheeting lengths are substantially of like width substantially coextensive with the transverse span dimension extending across the roof support plane longitudinal surfaces of adjacent pairs of said structural units and the step of unrolling said sheeting lengths is applicable to a pair of said units per unrolling.

17. The method of fabrication in accordance with claim 16 including the step of pre-applying adhesive to the receptive roof support plane surfaces of said units on which said sheeting lengths are to be mounted.

18. The method of fabrication in accordance with claim 17 in which said adhesive is provided by a double faced adhesive tape.

19. the method of fabrication in accordance with claim 18 in which said sheeting comprises a polymer plastic composition.

20. The method of fabrication in accordance with claim 19 in which the step of applying insulation comprises unrolling insulation from source rolls of predetermined thickness nonlaminated fiberglass over the surface area of the previously applied vapor barrier sheeting.

21. The method of fabrication in accordance with claim 20 in which the insulation is unrolled in a direction substantially transverse to the longitudinal direction of said structural units and juxtaposed lengths of the insulation are fitted together in a butt-match relationship.

22. A method of fabricating a roof for a building having in place a plurality of parallel and spaced apart elongated structural support units defining an uppermost longitudinal roof support plane surface exposed from above and comprising the sequential steps of:

(a) unrolling a first length of flexible moisture impervious vapor barrier sheeting composition from a source roll of said sheeting in the longitudinal direction of said structural units for mounting onto the longitudinal roof support plane surfaces of some of said units while covering a first intervening space therebetween substantially taut and unsupported thereover;

(b) unrolling a second length of flexible moisture impervious vapor barrier sheeting composition from a source roll of said sheeting in the longitudinal direction of said structural units for mounting onto the longitudinal roof support plane surface of others of said support units while covering a second intervening space therebetween substantially taut and unsupported thereover and while omitting coverage of a third intervening space laterally separating said first and second intervening spaces;

(c) unrolling a third length of flexible moisture impervious vapor barrier sheeting composition from a source roll of said sheeting in the longitudinal direction of such structural units for covering said third intervening space substantially taut and unsupported thereover by mounting said third length into an overlapping relationship with the border surfaces of said first and second lengths to form with said first and second lengths a continuous uninterrupted vapor barrier providing spanned coverage over said first, second and third intervening spaces;

(d) applying substantially continuous insulation overlying said vapor barrier sheeting; and (e) securing a hard roofing to said support units in overlying and adjacent relation to said insulation.

* * * * *

UNITED STATES PATENT AND TRADEMARK OFFICE

CERTIFICATE OF CORRECTION

PATENT NO. : 4,736,552

DATED : April 12, 1988

INVENTOR(S) : Lonnie R. Ward, Cherryl A. Ward

It is certified that error appears in the above-identified patent and that said Letters Patent is hereby corrected as shown below:

Column 1, Line 40 after "comprise" insert the following: --fiberglass batts, boards, blankets or loose fill insulation such as--

Signed and Sealed this

Sixth Day of September, 1988

*Attest:*

DONALD J. QUIGG

*Attesting Officer*

*Commissioner of Patents and Trademarks*